US009755353B2

(12) United States Patent
Tsai et al.

(10) Patent No.: US 9,755,353 B2
(45) Date of Patent: Sep. 5, 2017

(54) WATERPROOF AND INTERFERENCE PROOF RECEPTACLE CONNECTOR

(71) Applicant: Advanced-Connectek Inc., New Taipei (TW)

(72) Inventors: Yu Lun Tsai, New Taipei (TW); Pin-Yuan Hou, New Taipei (TW); Chung-Fu Liao, New Taipei (TW); Ya-Fen Kao, New Taipei (TW); Rui Su, New Taipei (TW); Long-Fei Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/080,372

(22) Filed: Mar. 24, 2016

(65) Prior Publication Data

US 2016/0294108 A1 Oct. 6, 2016

(30) Foreign Application Priority Data

Mar. 31, 2015 (CN) ..... 2015 1 0146738

(51) Int. Cl.

| | |
|---|---|
| ***H01R 24/00*** | (2011.01) |
| ***H01R 33/00*** | (2006.01) |
| ***H01R 13/52*** | (2006.01) |
| ***H01R 13/6581*** | (2011.01) |
| *H01R 107/00* | (2006.01) |
| *H01R 12/55* | (2011.01) |

(52) U.S. Cl.

CPC ..... *H01R 13/5219* (2013.01); *H01R 13/6581* (2013.01); *H01R 12/55* (2013.01); *H01R 2107/00* (2013.01)

(58) Field of Classification Search

CPC ..... H01R 13/648; H01R 13/6581; H01R 13/6585; H01R 13/658; H01R 23/688

USPC ..... 439/607.01, 607.04, 607.4, 607.55

See application file for complete search history.

(56) References Cited

U.S. PATENT DOCUMENTS

| | | | | |
|---|---|---|---|---|
| 6,921,292 | B2 * | 7/2005 | Miyazaki | H01R 9/032 439/564 |
| 2010/0248552 | A1 * | 9/2010 | He | H01R 27/02 439/638 |
| 2012/0108095 | A1 * | 5/2012 | Liu | H01R 13/5219 439/271 |
| 2013/0065442 | A1 * | 3/2013 | Nagata | H01R 13/5202 439/607.58 |

(Continued)

FOREIGN PATENT DOCUMENTS

KR 20160042752 A * 10/2016 ..... H01R 13/648

*Primary Examiner* — Abdullah Riyami
*Assistant Examiner* — Thang Nguyen
(74) *Attorney, Agent, or Firm* — patenttm.us

(57) ABSTRACT

A waterproof and interference proof receptacle connector has an upper insulative housing, a lower insulative housing, a first terminal set, a second terminal set, a shell, a watertight casing and an interference proof rear guard. The first and second terminal sets are mounted respectively on the upper and lower insulative housings. The shell is mounted on the upper and lower insulative housings. The watertight casing is mounted around the shell. The interference proof guard is mounted on the watertight casing. The watertight casing provides a waterproof function to allow the waterproof and interference proof receptacle connector to operate in humid or underwater environment.

19 Claims, 8 Drawing Sheets

(56) References Cited

U.S. PATENT DOCUMENTS

| | | | | |
|---|---|---|---|---|
| 2014/0051303 | A1* | 2/2014 | Yu | H01R 13/46<br>439/660 |
| 2015/0056855 | A1* | 2/2015 | Yu | H01R 13/6594<br>439/607.01 |
| 2015/0155661 | A1* | 6/2015 | Chen | H01R 13/6594<br>439/607.01 |
| 2015/0255905 | A1* | 9/2015 | Little | H01R 13/6658<br>439/78 |
| 2015/0270661 | A1* | 9/2015 | Kao | H01R 13/5202<br>439/271 |
| 2016/0104957 | A1* | 4/2016 | Kim | H01R 13/6581<br>439/78 |
| 2016/0141792 | A1* | 5/2016 | Zhao | H01R 13/6581<br>439/78 |
| 2016/0181733 | A1* | 6/2016 | Duan | H01R 13/6594<br>439/607.05 |
| 2016/0233594 | A1* | 8/2016 | Zhao | H01R 13/6581 |
| 2016/0294104 | A1* | 10/2016 | Zhao | H01R 13/5202 |

* cited by examiner

WATERPROOF AND INTERFERENCE PROOF RECEPTACLE CONNECTOR

BACKGROUND OF THE INVENTION

1. Field of the Invention

The present invention relates to a receptacle connector, and more particularly to a waterproof and interference proof receptacle connector that is applied to a humid or underwater environment and prevents itself from interfering with external electrical components.

2. Description of Related Art

Electrical connectors are general electrical components on electronic devices widely used for connecting to other matching connectors on the other electrical devices for signal transmission and power supply. A conventional universal serial bus (USB) Type C connector has an insulative housing, two sets of terminals and a metal shell. The sets of the terminals are mounted on the insulative housing for signal transmission and each terminal has a soldering section to be soldered on an external circuit board.

More and more portable electrical devices, equipped with USB or USB Type C connectors for connecting to other devices or power banks, are used in humid or underwater environments. However, the conventional USB Type C connectors are not designed with any waterproof features and cannot operate in humid or underwater environments.

Furthermore, the conventional USB Type C connectors lack interference-proof mechanism so the exposed soldering sections of the terminals easily interfere with external electronic components, which causes signal transmission of the USB Type C connectors unstable or less efficient and unable to achieve ideal transmission rate.

To overcome the shortcomings, the present invention provides a waterproof and interference proof receptacle connector to mitigate or obviate the aforementioned problems.

SUMMARY OF THE INVENTION

The main objective of the invention is to provide a waterproof and interference proof receptacle connector that is applied to a humid or underwater environment and prevents itself from interfering with external electrical components.

A waterproof and interference proof receptacle connector in accordance with the present invention comprises an upper insulative housing, a lower insulative housing, a first terminal set, a second terminal set, a shell, a watertight casing and an interference proof rear guard. The first and second terminal sets are mounted respectively on the upper and lower insulative housings. The shell is mounted on the upper and lower insulative housings. The watertight casing is mounted around the shell. The interference proof rear guard is mounted on the watertight casing. The watertight casing provides a waterproof function to allow the waterproof and interference proof receptacle connector to operate in humid or underwater environment.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
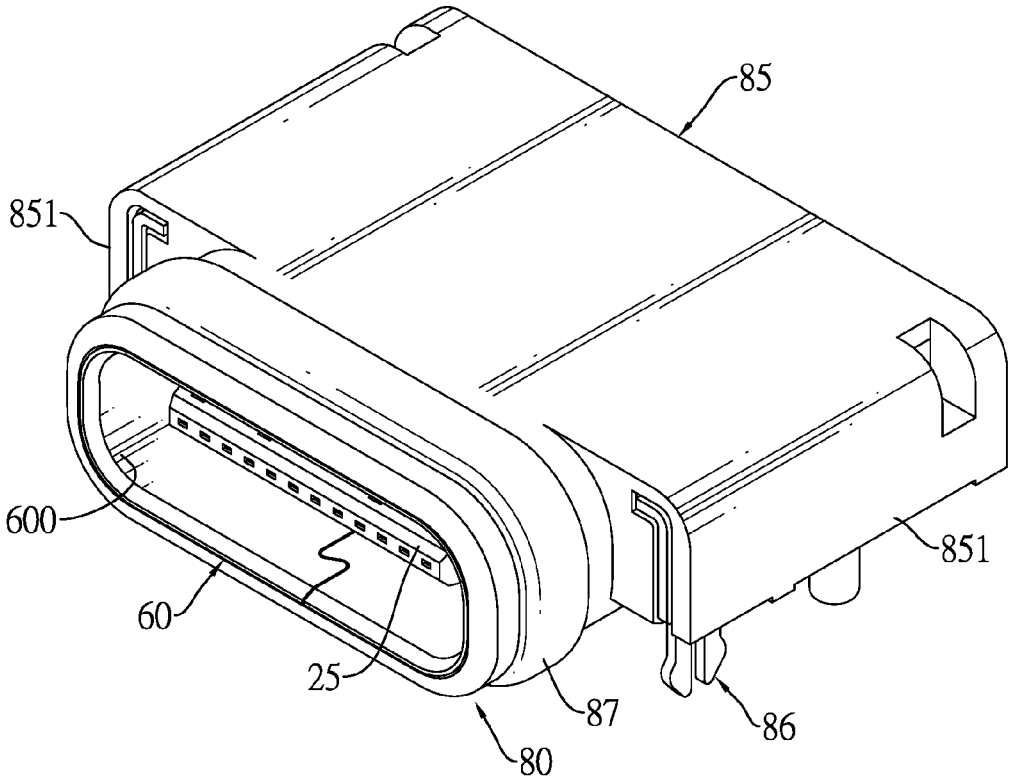
FIG. 1 is a perspective view of a waterproof and interference proof receptacle connector in accordance with the present invention.
Figure 2:
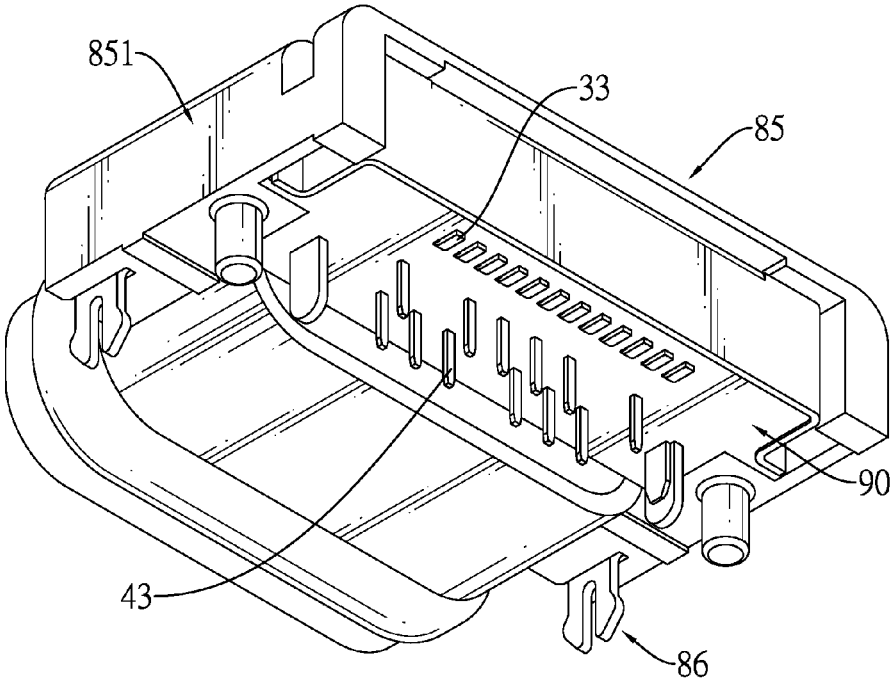
FIG. 2 is another perspective view of the waterproof and interference proof receptacle connector in FIG. 1.
Figure 6:
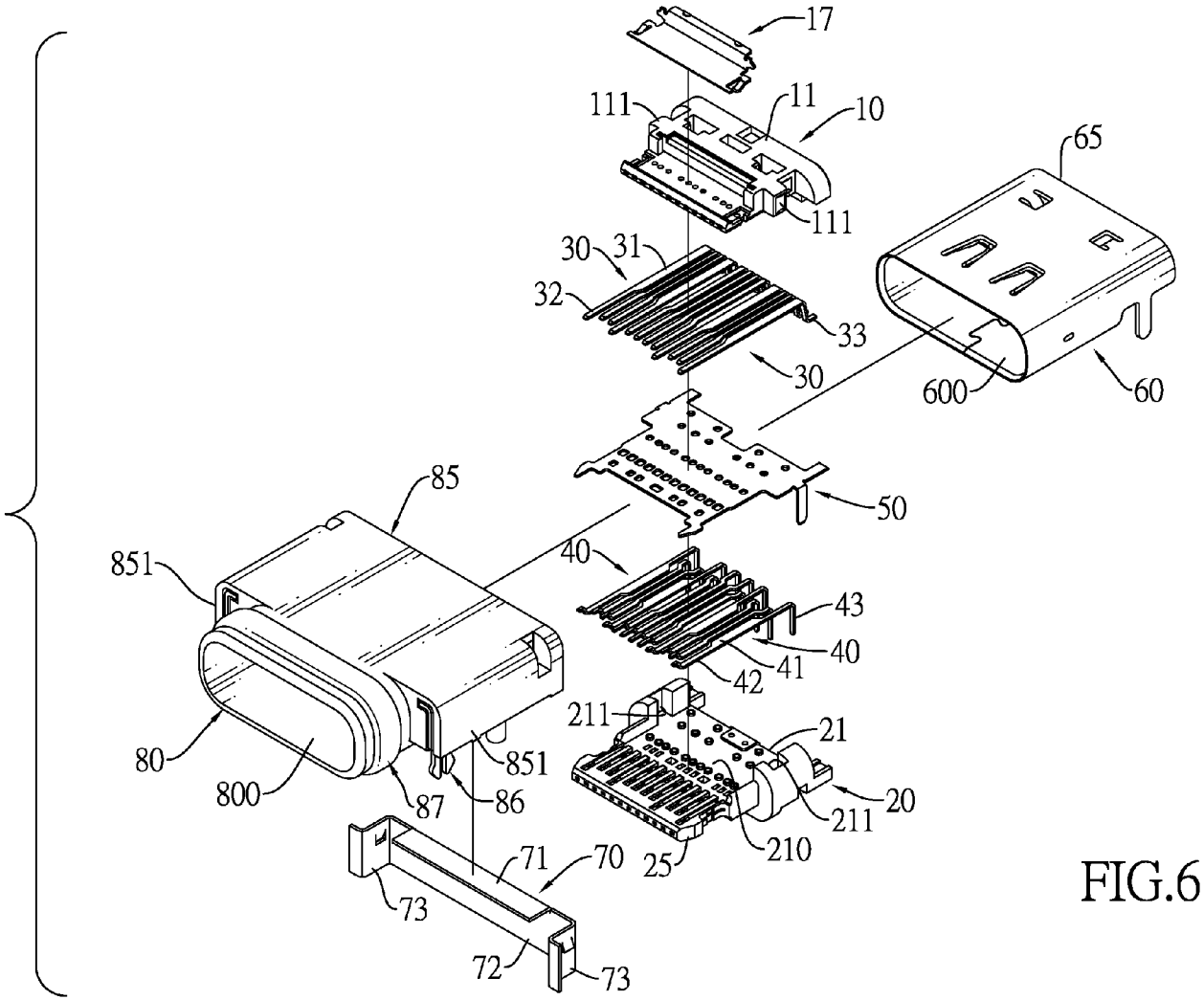
FIG. 6 is an exploded perspective view of the waterproof and interference proof receptacle connector in FIG. 1 omitting the watertight glue.

With reference to FIGS. 1, 2 and 6, a waterproof and interference proof receptacle connector in accordance with the present invention may be a USB Type-C connector, and complies with the USB Type-C Cable and Connector Specification ver. 0.98C or newer version set by the USB implementers Forum (USB IF).

The waterproof and interference proof receptacle connector in accordance with the present invention comprises an upper insulative housing 10, a lower insulative housing 20, a first terminal set, a second terminal set, a shielding grounding plate 50, a shell 60, a watertight casing 80 and an interference proof rear guard 70.

Figure 3:
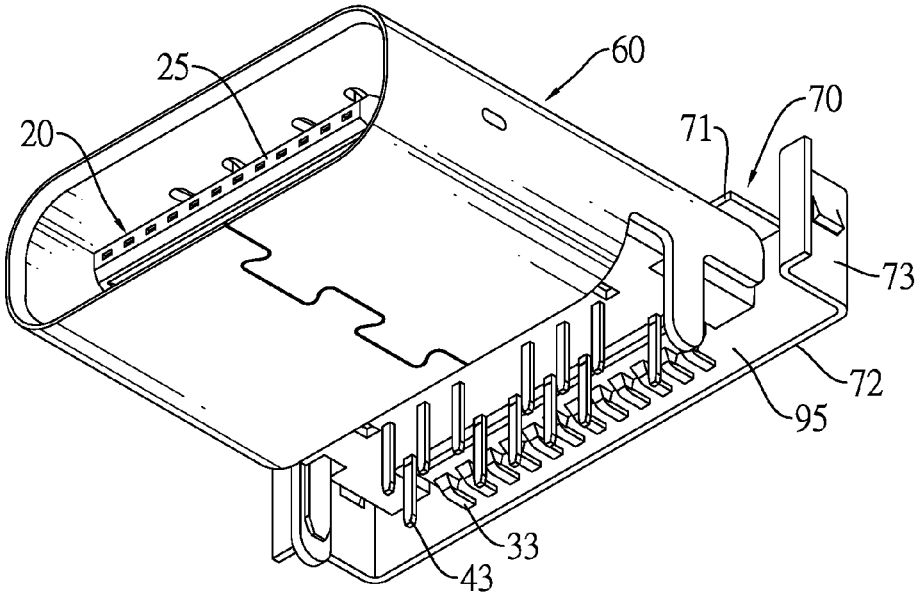
FIG. 3 is a perspective view of the waterproof and interference proof receptacle connector in FIG. 1 omitting a watertight casing and a watertight glue.
Figure 4:
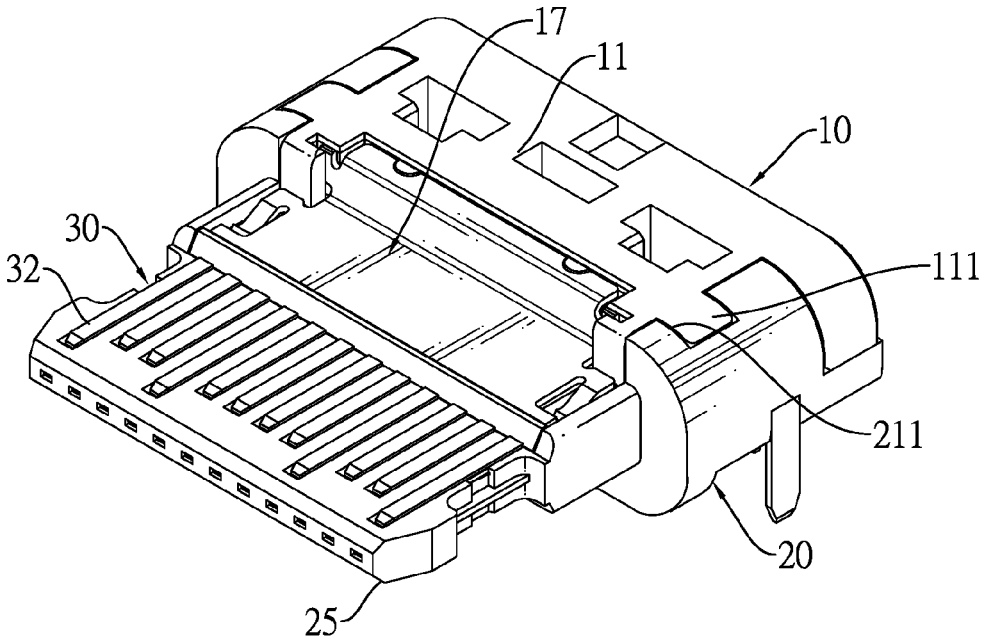
FIG. 4 is a perspective view of the waterproof and interference proof receptacle connector in FIG. 1 omitting a shell, the watertight casing and the watertight glue.

With reference to FIGS. 3 and 4, the upper insulative housing 10 has an upper mounting bracket 11, two assembling protrusions 111 and an upper shielding board 17. The assembling protrusions 111 are formed respectively on two opposite sides of the upper mounting bracket 11. The upper shielding board 17 is mounted on a top of the upper mounting bracket 11 to provide shielding effect for terminals.

The lower insulative housing 20 is mounted on a bottom of the upper insulative housing 10 and has a lower mounting bracket 21 and a tongue board 25. The lower mounting bracket 21 has a mounting recess 210 and two assembling slots 211. The mounting recess 210 is defined in a top of the lower mounting bracket 21 and accommodates the upper mounting bracket 11. The assembling slots 211 are defined respectively in two opposite inner sidewalls of the mounting recess 210 and respectively receive the assembling protrusions 111. The tongue board 25 is formed on and protrudes forward from the lower mounting bracket 21.

The first terminal set and the second terminal set are respectively mounted on the upper insulative housing 10 and the lower insulative housing 20, and are substantially pointing symmetrical to each other with respect to a centre of symmetry of the tongue board 25. According to point symmetrical configuration of the first and second terminal sets, when the first and second terminal sets are rotated for 180 degrees with respect to the centre of symmetry, the rotated first and second terminal sets coincide with and are identical to the first and second terminal sets without rotation of 180 degrees. By the point symmetrical configuration of the first and second terminal sets, an electrical plug connector can extend reversely into the receptacle connector to normally implement high speed signal transmission.

Figure 5:
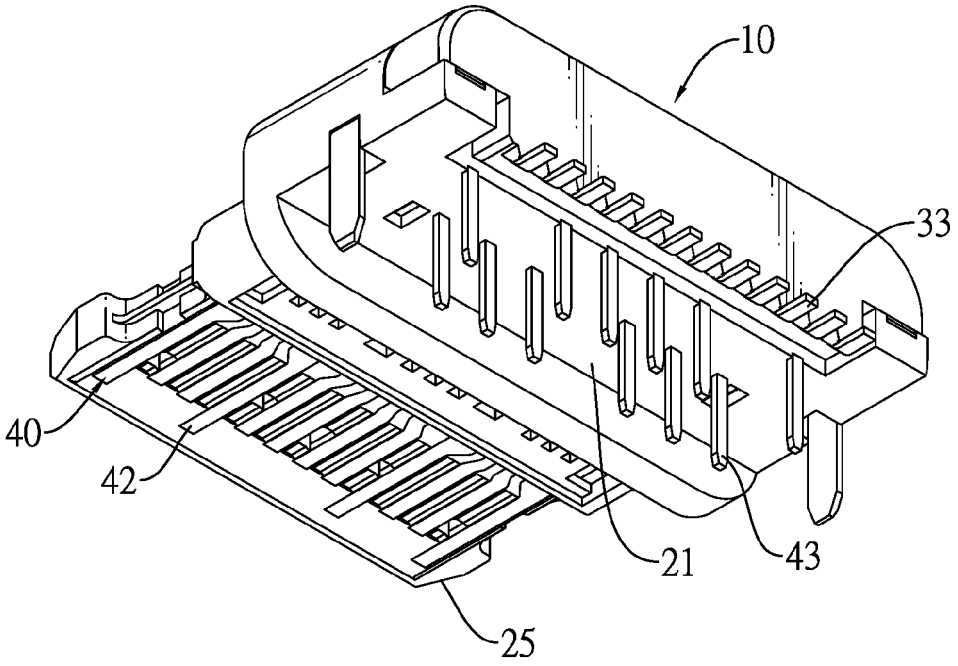
FIG. 5 is another perspective view of the waterproof and interference proof receptacle connector in FIG. 1 omitting a shell, the watertight casing and the watertight glue.
Figure 7:
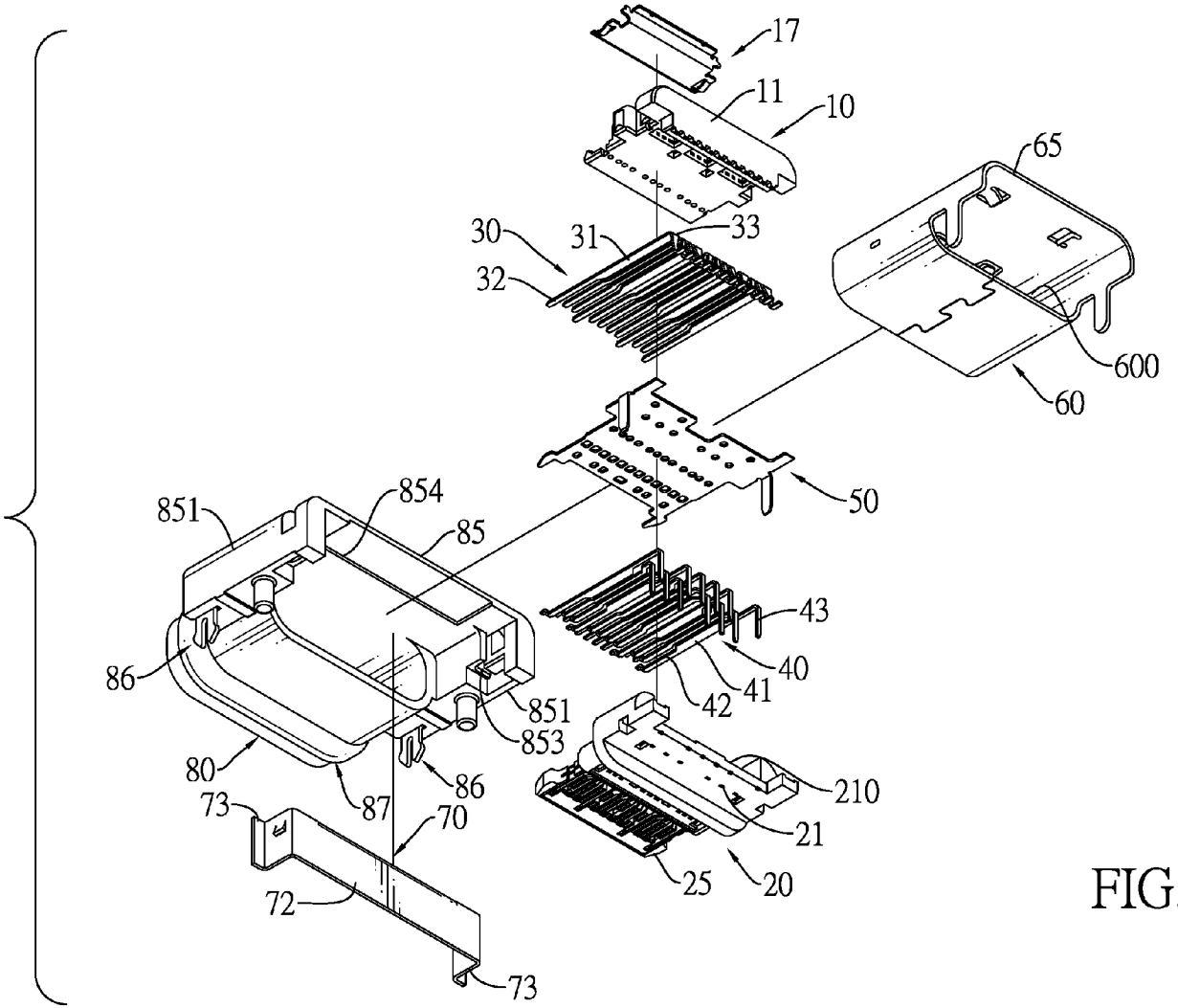
FIG. 7 is another exploded perspective view of the waterproof and interference proof receptacle connector in FIG. 1 omitting the watertight glue.

With further reference to FIGS. 5 and 7, the first terminal set is mounted on the upper insulative housing 10 and has multiple first terminals 30. Each first terminal 30 has a first mounting section 31, a first electrical contacting section 32 and a first soldering section 33. The first mounting section 31 is mounted on the insulative housing 10. The first electrical contacting section 32 is formed on and protrudes forward from the first mounting section 31 and is mounted on a top of the tongue board 25 of the lower insulative housing 20. The first soldering section 33 is formed on and protrudes backward from the first mounting section 31.

Figure 8:
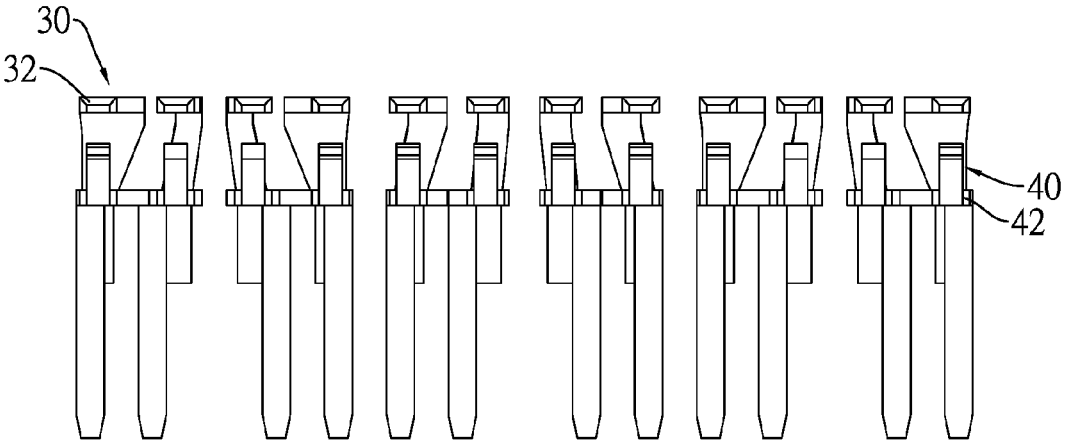
FIG. 8 is a front view of a set of first terminals and a set of second terminals of the waterproof and interference proof receptacle connector in FIG. 1.

With further reference to FIG. 8, the second terminal set is mounted on the lower insulative housing 20 and has multiple second terminals 40. Each second terminal 40 has a second mounting section 41, a second electrical contacting section 42 and a second soldering section 43. The second mounting section 41 is mounted on the lower insulative housing 20. The second electrical contacting section 42 is formed on and protrudes forward from the second mounting section 41 and is mounted on a bottom of the tongue board 25 of the lower insulative housing 20. The second soldering section 43 is formed on and protrudes backward from the second mounting section 41.

The shielding grounding plate 50 is mounted between the upper insulative housing 10 and the lower insulative housing 20 and is disposed between the first terminal set and the second terminal set to prevent crosstalk between the first terminal set and the second terminal set.

The shell 60 is mounted on the upper insulative housing 10 and the lower insulative housing 20 and has a cavity 600 and an extension tab 65. The cavity 600 is defined through the shell 60 and accommodates the upper insulative housing 10, the lower insulative housing 20, the first terminal set and the second terminal set. The extension tab 65 is formed on and protrudes backward from a rear end of the shell 60.

The watertight casing 80 is mounted around the shell 60 and has a mounting hole 800, a fitting member 85, a watertight ring 87, two mounting legs 86, a positioning slot 854 and two embedding recesses 853. The mounting hole 800 is defined through the watertight casing 80 and accommodates the shell 60. The watertight ring 87 is resilient, may be made of rubber and is mounted around the watertight casing 80. The fitting member 85 is inverted U-shaped, is mounted on the extension tab 65 of the shell 60 and has two opposite side surfaces 851. The mounting legs 86 are mounted respectively on the side surfaces 851 and are able to be inserted and hooked in openings in a circuit board. The positioning slot 854 is defined in an inner top surface of the fitting member 85. The embedding recesses 853 are defined respectively in the side surfaces 851.

The interference proof rear guard 70 is made of metal, is mounted in the fitting member 85 of the watertight casing 80 and has a fitting tab 71, a shielding guard tab 72 and two wings 73. The fitting tab 71 is mounted in the positioning slot 854 of the fitting member 85 of the watertight casing 80. The shielding guard tab 72 is formed on and protrudes downward from the fitting tab 71. The wings 73 are formed on and protrude forward respectively from two side ends of the shielding guard tab 72 and are mounted respectively in the embedding recesses 853 in the fitting member 85. A rear end of the upper insulative housing 10, a rear end of the lower insulative housing 20, the fitting member 85 of the watertight casing 80 and the shielding guard tab 72 of the interference proof rear guard 70 collaborate to form a glue space 95 to receive watertight glue 90.

The waterproof and interference proof receptacle connector in accordance with the present invention has the following advantages.

1. The waterproof function. The rear end of the upper insulative housing 10, the rear end of the lower insulative housing 20, the fitting member 85 of the watertight casing 80 and the shielding guard tab 72 of the interference proof rear guard 70 collaborate to form the glue space 95 to receive watertight glue 90. Therefore, the waterproof and interference proof receptacle connector is constructed with a waterproof characteristic and is capable of operating in humid or underwater environment.

2. The metal interference proof rear guard 70 provides the first soldering sections 33 of the first terminals 30 and the second soldering sections 43 of the second terminals 40 with an electromagnetic shielding function to avert the first terminals 30 and the second terminals 40 from electromagnetically interfering with external electronic components. Therefore, signal transmission of the waterproof and interference proof receptacle connector is improved to acquire better stability and higher efficiency.

3. The upper shielding board 17 further shields the first terminals 30 from electromagnetic interference.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A receptacle connector comprising:

an upper insulative housing;

a lower insulative housing mounted on a bottom of the upper insulative housing;

a first terminal set and a second terminal set substantially pointing symmetrical to each other;

the first terminal set mounted on the upper insulative housing and having multiple first terminals, each first terminal having a first mounting section mounted on the insulative housing;

a first electrical contacting section formed on and protruding forward from the first mounting section; and a first soldering section formed on and protruding backward from the first mounting section;

the second terminal set mounted on the lower insulative housing and having multiple second terminals, each second terminal having a second mounting section mounted on the lower insulative housing;

a second electrical contacting section formed on and protruding forward from the second mounting section; and a second soldering section formed on and protruding backward from the second mounting section;

a shell mounted on the upper insulative housing and the lower insulative housing and having a cavity defined through the shell and accommodating the upper insulative housing, the lower insulative housing, the first terminal set and the second terminal set; and an extension tab formed on and protruding backward from a rear end of the shell;

a watertight casing mounted around the shell and having a mounting hole defined through the watertight casing and accommodating the shell; and a fitting member mounted on the extension tab of the shell, wherein the fitting member is inverted U-shaped and has two opposite side surfaces; and an interference proof rear guard mounted in the fitting member of the watertight casing and having a fitting tab;

a shielding guard tab formed on and protruding downward from the fitting tab; and two wings formed on and protruding forward respectively from two side ends of the shielding guard tab; wherein a rear end of the upper insulative housing, a rear end of the lower insulative housing, the fitting member of the watertight casing and the shielding guard tab of the interference proof rear guard collaborate to form a glue space to receive watertight glue.

2. The receptacle connector as claimed in claim 1, wherein a shielding grounding plate is mounted between the upper insulative housing and the lower insulative housing and disposed between the first terminal set and the second terminal.

3. The receptacle connector as claimed in claim 2, wherein the watertight casing further has a watertight ring being resilient and mounted around the watertight casing.

4. The receptacle connector as claimed in claim 3, wherein two mounting legs are mounted respectively on the side surfaces of the fitting member.

5. The receptacle connector as claimed in claim 4, wherein the upper insulative housing has an upper mounting bracket; and the lower insulative housing has a lower mounting bracket having a mounting recess defined in a top of the lower mounting bracket and accommodating the upper mounting bracket; and a tongue board formed on and protruding forward from the lower mounting bracket, wherein the first terminal set and the second terminal set substantially are pointing symmetrical to each other with respect to a centre of symmetry of the tongue board.

6. The receptacle connector as claimed in claim 5, wherein the upper insulative housing further has two assembling protrusions formed respectively on two opposite sides of the upper mounting bracket; and the lower mounting bracket of the lower insulative housing has two assembling slots defined respectively in two opposite inner sidewalls of the mounting recess and respectively receiving the assembling protrusions.

7. The receptacle connector as claimed in claim 6, wherein the first electrical contacting section is mounted on a top of the tongue board of the lower insulative housing; and the second electrical contacting section is mounted on a bottom of the tongue board of the lower insulative housing.

8. The receptacle connector as claimed in claim 7, wherein the upper insulative housing further has an upper shielding board mounted on a top of the upper mounting bracket.

9. The receptacle connector as claimed in claim 8, wherein the watertight casing has a positioning slot defined in an inner top surface of the fitting member; and two embedding recesses defined respectively in the side surfaces; and the fitting tab of the interference proof rear guard is mounted in the positioning slot of the fitting member of the watertight casing;

the wings are mounted respectively in the embedding recesses in the fitting member.

10. The receptacle connector as claimed in claim 9, wherein the interference proof rear guard is made of metal.

11. The receptacle connector as claimed in claim 1, wherein the receptacle connector is a receptacle connector.

12. A receptacle connector comprising:

an insulative housing comprising a tongue board and a bracket;

a first terminal set disposed in the insulative housing and having multiple first terminals, each first terminal having:

a first mounting section retained in the insulative housing;

a first electrical contacting section protruding forward from the first mounting section and disposed on a top surface of the tongue board; and a first soldering section protruding backward from the first mounting section;

a second terminal set disposed in the insulative housing and having multiple second terminals, each second terminal having:

a second mounting section retained in the insulative housing;

a second electrical contacting section protruding forward from the second mounting section and disposed on a bottom surface of the tongue board; and a second soldering section protruding backward from the second mounting section, wherein the first terminal set and the second terminal set are substantially pointing symmetrical to each other with respect to a center of symmetry of the tongue board;

a shell enclosed the insulative housing and having:

a cavity defined through the shell and accommodating the insulative housing, the first terminal set and the second terminal set; and an extension tab formed on and protruding backward from a rear end of the shell;

a watertight casing enclosed the shell and having:

a mounting hole defined through the watertight casing and accommodating the shell; and a fitting member coupled to the extension tab of the shell; and an interference proof rear guard coupled to the fitting member of the watertight casing and having:

a fitting tab;

a shielding guard tab formed on and protruding downward from the fitting tab; and two wings formed on and protruding forward respectively from two side ends of the shielding guard tab, wherein the fitting member is inverted U-shaped and has two opposite side surfaces and a rear end of the insulative housing; the fitting member of the watertight casing and the shielding guard tab of the interference proof rear guard collaborate to form a glue space to receive watertight glue.

13. The receptacle connector as claimed in claim 12 further comprises two mounting legs are mounted respectively on the side surfaces.

14. The receptacle connector as claimed in claim 12, wherein a shielding grounding plate is disposed between the first terminal set and the second terminal.

15. The receptacle connector as claimed in claim 12, wherein insulative housing comprises:

an upper insulative housing; and a lower insulative housing coupled to a bottom of the upper insulative housing in a vertical direction, wherein the first terminal set is disposed in the upper insulative housing and the second terminal set disposed in the lower insulative housing.

16. The receptacle connector as claimed in claim 15, wherein a shielding grounding plate is disposed between the upper insulative housing and the lower insulative housing and between the first terminal set and the second terminal.

17. The receptacle connector as claimed in claim 16, wherein the upper insulative housing has an upper mounting bracket and the lower insulative housing has a lower mounting bracket having a mounting recess defined in a top of the lower mounting bracket and accommodating the upper mounting bracket, wherein the tongue board is formed on and protruding forward from the lower mounting bracket.

18. The receptacle connector as claimed in claim 17, wherein the upper insulative housing further has two assembling protrusions formed respectively on two opposite sides of the upper mounting bracket; and the lower mounting bracket of the lower insulative housing has two assembling slots defined respectively in two opposite inner sidewalls of the mounting recess and respectively receiving the assembling protrusions.

19. The receptacle connector as claimed in claim 14, wherein the upper insulative housing further has an upper shielding board mounted on a top of the upper mounting bracket.

* * * * *